US011149484B1

(12) United States Patent
Bouzianis

(10) Patent No.: US 11,149,484 B1
(45) Date of Patent: Oct. 19, 2021

(54) DOOR STOP

(71) Applicant: Gregory Bouzianis, Topeka, KS (US)

(72) Inventor: Gregory Bouzianis, Topeka, KS (US)

( * ) Notice: Subject to any disclaimer, the term of this patent is extended or adjusted under 35 U.S.C. 154(b) by 2 days.

(21) Appl. No.: 16/737,630

(22) Filed: Jan. 8, 2020

Related U.S. Application Data

(60) Provisional application No. 62/791,241, filed on Jan. 11, 2019.

(51) Int. Cl.
*E05F 5/06* (2006.01)
*E05F 5/02* (2006.01)

(52) U.S. Cl.
CPC ..... *E05F 5/02* (2013.01); *E05Y 2201/224* (2013.01); *E05Y 2201/246* (2013.01); *E05Y 2201/266* (2013.01); *E05Y 2201/484* (2013.01)

(58) Field of Classification Search
CPC ..... E05C 17/00; E05C 17/46; E05C 17/54; E05C 17/44; E05C 17/025; E05F 5/02; E05F 5/06; E05F 5/08; E05F 5/18; E05F 5/00; E05Y 2900/132; E05Y 2201/212; E05Y 2201/224; E05Y 2201/246; E05Y 2201/266; E05Y 2201/484; Y10T 292/71; Y10T 292/73; Y10T 16/61; Y10T 16/625
See application file for complete search history.

(56) References Cited

U.S. PATENT DOCUMENTS 1,044,728 A * 11/1912 Basler ..... E05C 17/443 292/338
2,249,294 A * 7/1941 Kohler ..... E05B 17/005 292/1
2,709,615 A * 5/1955 Barnes, Jr. ..... E05C 17/443 292/339
2,739,005 A * 3/1956 Naffziger ..... E05C 17/443 292/339
3,357,732 A * 12/1967 Seal ..... E05C 17/50 292/60
4,310,947 A * 1/1982 Salerno ..... E05F 5/003 16/83
4,982,474 A * 1/1991 Kjellstrom ..... E05C 17/04 16/82
6,327,743 B1 * 12/2001 Rashid ..... E05B 17/005 16/82
6,510,587 B2 * 1/2003 Urschel ..... E05B 17/005 16/82
8,028,376 B2 * 10/2011 Karapetyan ..... E05B 17/005 16/82
8,595,899 B2 * 12/2013 McRoskey ..... E05F 5/003 16/83

(Continued)

FOREIGN PATENT DOCUMENTS

GB 2258270 A * 2/1993 ..... E05C 17/54
JP 2016098585 A * 5/2016

*Primary Examiner* — Chuck Y Mah
(74) *Attorney, Agent, or Firm* — Avant Law Group, LLC

(57) ABSTRACT

A door stop for a door includes a clamp that is securable over a first side edge of a door. The clamp has a guide. An arm has a receiving portion for receiving the guide to permit movement of the arm on the clamp between an open position and a closed position. A spring mechanism is operably coupled to the clamp and the arm, and urges the arm on the guide of the clamp toward the closed position. In the closed position, the arm prevents the door from engaging with a respective door jamb.

18 Claims, 18 Drawing Sheets

(56) References Cited

U.S. PATENT DOCUMENTS

| | | | | |
|---|---|---|---|---|
| 8,656,555 | B2 * | 2/2014 | Brown | E05F 5/06 16/85 |
| 8,776,316 | B2 * | 7/2014 | McRoskey | E05F 5/02 16/85 |
| 8,893,351 | B2 * | 11/2014 | Payson | E05F 5/08 16/85 |
| 10,822,854 | B2 * | 11/2020 | Lee | F16M 13/022 |
| 2006/0162255 | A1 * | 7/2006 | Lee | E06B 7/36 49/383 |

* cited by examiner

DOOR STOP

CROSS-REFERENCE TO RELATED APPLICATIONS

This application claims the benefit of priority of U.S. Application No. 62/791,241 filed Jan. 11, 2019.

BACKGROUND OF THE INVENTION

Field of the Invention

The invention is directed to a finger pinch protector device for a door. In particular, the invention is directed to a door stop for a door that may be installed and removed without any tools or other equipment, that will not mar or otherwise damage a door, and that may be activated by engagement of the door with the doorjamb.

Description of the Related Art

Accidental closing of doors can cause pinched fingers. Young children may be at risk of accidental closing of doors and finger injury. A number of devices in the past have been directed to controlling door closing. Commercial door closer devices will often prevent a door from closing at a rapid pace. These require considerable installation effort, are typically permanent installations, and mar both the door and the doorframe.

Other simple devices include bumpers which may be slipped over a side edge of the door. These devices can be slipped onto a door once it is opened but then require removal of the device before the door can close again.

There remains a need for a door stop for a door that may be easily installed and easily removed as desired. There also remains a need for a door stop for a door that may be installed and removed without any tools or equipment and will not mar or damage the door or the doorframe. There also remains a need for a door stop that may be activated by engagement of the door with a doorjamb.

SUMMARY OF THE INVENTION

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

The invention is directed to a door stop for a door. According to embodiments of the invention, the device includes a clamp which is configured to fit over and secure over a first side edge of a door. The width of the clamp may be slightly less than the width of the door and such that it may be secured to the door by spring force. The clamp has an elongated planar body with two parallel guide rails extending from the planar body of the clamp. Each guide rail extends outward from the planar body of the clamp at an acute angle. The elongated latch includes a pair of parallel tracks which align with and receive the parallel guide rails of the clamp. The elongated latch includes one beveled end which is utilized to engage the doorjamb and activate the device. A latch spring mechanism urges the elongated latch along the guide rails of the clamp toward the doorjamb. Spring tension from an elastic band of the latch spring mechanism urges and pulls the latch along the guide rails of the clamp until the clamp engages a shoulder of the latch. The beveled edge of the clamp will extend beyond the clamp when the latch spring mechanism has urged the latch on the clamp. When the beveled edge of the latch of the device comes in contact with a doorjamb, the force will urge the latch against and overcome the force of the latch spring mechanism.

A rotor of the device has an extending post with a tubular opening which is received over a cylinder extending from the planar body of the clamp. A fastener fastens into the tubular opening of the post and engages the cylinder. The extending post and cylinder act as an axis of rotation for the rotor. The rotor rotates approximately 90 degrees between a vertical position and a safety horizontal position which is substantially parallel to both the latch and the clamp.

A rotor spring mechanism having an elastic band extends between the rotor and the latch. The rotor spring mechanism urges the rotor toward the horizontal safety position. An underside of the rotor contains a pair of locating pins which mate with corresponding recesses in the latch.

When the latch engages the doorjamb, the latch is urged or moved with respect to the clamp. At the same time, the rotor locating pins are forced from the locating recesses on the latch.

The force of the rotor spring mechanism thereby forces the rotor from the vertical position to move to the horizontal safety position. As the rotor projects beyond the edge of the open door, the rotor thereby prevents a door from closing.

According to one embodiment, a door stop for a door includes a clamp that is securable over a first side edge of a door. The clamp has a guide. An arm has a receiving portion for receiving the guide to permit movement of the arm on the clamp between an open position and a closed position. A spring mechanism is operably coupled to the clamp and the arm, and urges the arm on the guide of the clamp toward the closed position. In the closed position, the arm prevents the door from engaging with a respective door jamb.

According to another embodiment, a method of preventing a door from closing, includes securing a door stop to a first side edge of a door hingedly attached to a door frame. The door stop has a clamp with a guide and a biasing member. The door stop further includes a rotating member having a joining assembly. The joining assembly has a receiving portion that is configured to receive and rotate about the guide between an open and closed position, and a channel formed in an outer surface of the joining assembly that further defines a wall and a gap adjacent the wall. An arm extends from the joining assembly. A spring mechanism is operably secured to the clamp and the rotating member, and urges the arm toward the closed position. A first portion of the biasing member engages with the channel in the arm to rotate the arm between the closed and open positions. In the open position, the first leg is disposed in the gap such that it abuts the wall thus preventing rotation of the arm from the open position to the closed position. The method further includes moving the arm into the open position. When the first side edge of the door reaches the door jamb, the door jamb exerts a force on a second portion of the biasing member, the force causing the first portion of the biasing member to enter the channel in the joining assembly, whereby the arm rotates from the open position to the closed position thus preventing the door from closing.

According to still another embodiment a door stop broadly includes a clamp, a rotating member, and a biasing member. The clamp is securable over a side edge of a door and includes first, second, and third sides generally having a "U" configuration, the first and second faces being adjacent. A projection extends from the first face, and has a vertical opening formed along an outside edge thereof, a cavity, and a horizontal groove defined along a portion of a circumference of the projection. A track is defined in the first face along an outside edge of the first face. The clamp further includes a spring having a first portion and a second portion. The first portion is situated within the cavity, and the second portion extends into the horizontal groove and away from the projection. The rotating member is secured to the clamp and includes a joining assembly having a bottom face. The joining assembly comprises a receiving portion having a protrusion and a cutout. The joining assembly further includes a channel formed along an outside edge between the bottom face and a lip. The channel further defines a wall and a gap adjacent the wall. A pin extends from the bottom face, and an arm extends outwardly from the joining assembly. The protrusion of the receiving portion is received into the vertical opening of the projection of the clamp to mate the rotating member with the clamp. When mated, the second portion of the spring is received into the cutout in the receiving portion and biases the rotating member between an open and closed position, and the pin extends into the track in the clamp. The biasing member includes a first leg and a second leg generally having an "L" configuration. The biasing member engages with the crossbar of the clamp. In the closed position, the first leg of the biasing member engages with the channel in the joining assembly. In the open position, the first leg of the biasing member is disposed in the gap in the joining assembly such that the first leg abuts the wall, thus preventing the arm from moving from the open position to the closed position. When closing the door, and the first edge of the door reaches the door jamb, the door jamb exerts a force on the second leg of the biasing member, the force causing the first leg of the biasing member to leave the gap and enter the channel in the joining assembly, whereby the arm rotates from the open position into the closed position.

DETAILED DESCRIPTION OF THE INVENTION

The embodiments discussed herein are merely illustrative of specific manners in which to make and use the invention and are not to be interpreted as limiting the scope.

While the invention has been described with a certain degree of particularity, it is to be noted that many modifications may be made in the details of the invention's construction and the arrangement of its components without departing from the scope of this disclosure. It is understood that the invention is not limited to the embodiments set forth herein for purposes of exemplification.

Figure 1:
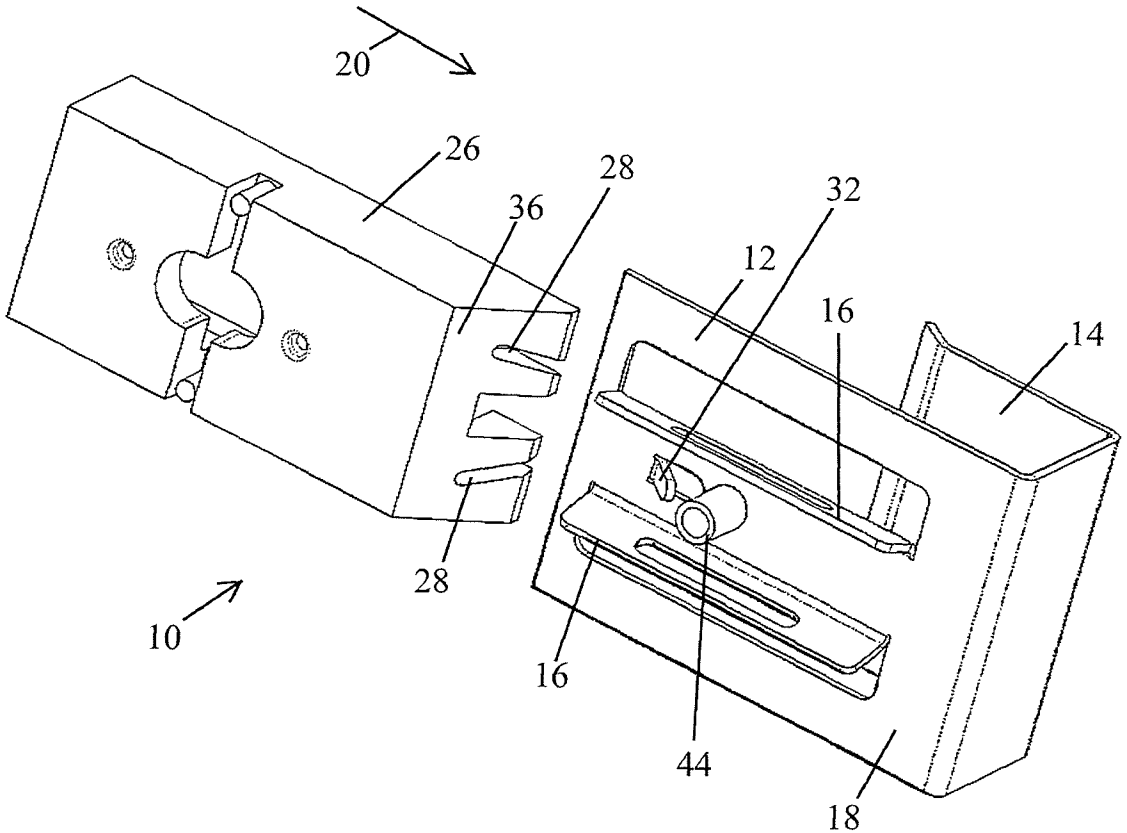
FIG. 1 is a perspective, exploded view of two elements or components of a finger pinch protector device constructed in accordance with embodiments of the invention.

Referring to the drawings in detail, FIG. 1 is a perspective, exploded view of two elements or components of a finger pinch protector device (i.e., door stop) 10 in accordance with the invention. The device 10 includes a clamp 12 which is configured to fit over and secure over a first side edge of a door (not shown in FIG. 1). The clamp 12 has an open mouth 14 to receive the side edge of the door. During installation, the clamp 12 will be inserted over the first side edge of the door opposed to the edge of the door having hinges thereon. The open mouth 14 of the device has a width slightly less than the width of a door and will be secured over the first side edge of the door by spring force.

The clamp 12 has an elongated planar body 18. The clamp 12 has at least one guide rail 16 extending from the planar body 18. In the embodiment shown in FIG. 1, two parallel guide rails 16 extend from the planar body 18 of the clamp 12. Each guide rail 16 extends outward from the planar body 18 of the clamp at an acute angle.

An elongated latch 26 includes at least one track 28 to receive the guide rail of the clamp 12. In the embodiment shown in FIG. 1, the latch 26 includes a pair of parallel tracks 28 which align with and receive the parallel guide rails 16 of the clamp. In order to assemble the device 10, the latch 26 is aligned with the clamp 12 and the latch 26 is engaged in the direction shown by arrow 20. The angled guide rails 16 and angled tracks 28 prevent the clamp 12 and latch 26 from separating. The latch 26 may be permitted to move along the planar body 18 of the clamp 12.

The elongated latch 26 also includes one beveled end 36. As will be explained, the beveled end 36 is utilized to engage the doorjamb and activate the device 10.

Figure 2:
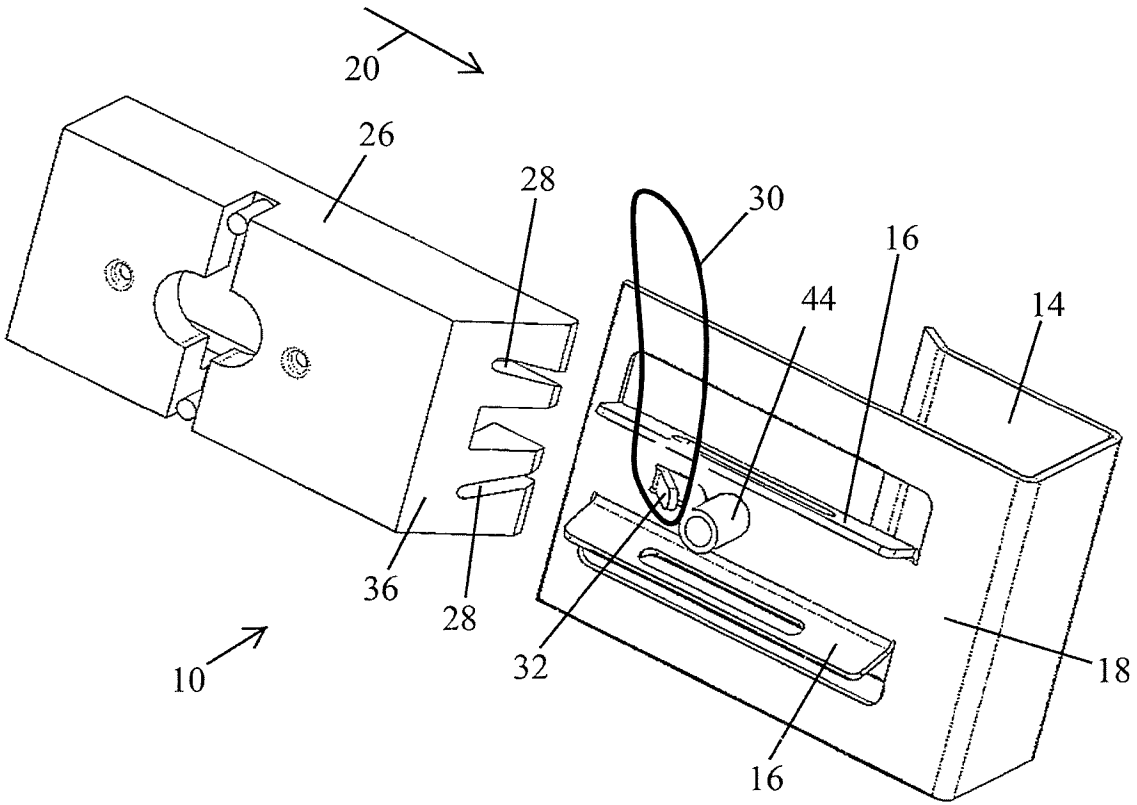
FIG. 2 is an exploded view of an elongated latch and clamp of the finger pinch protector device shown in FIG. 1.
Figure 3:
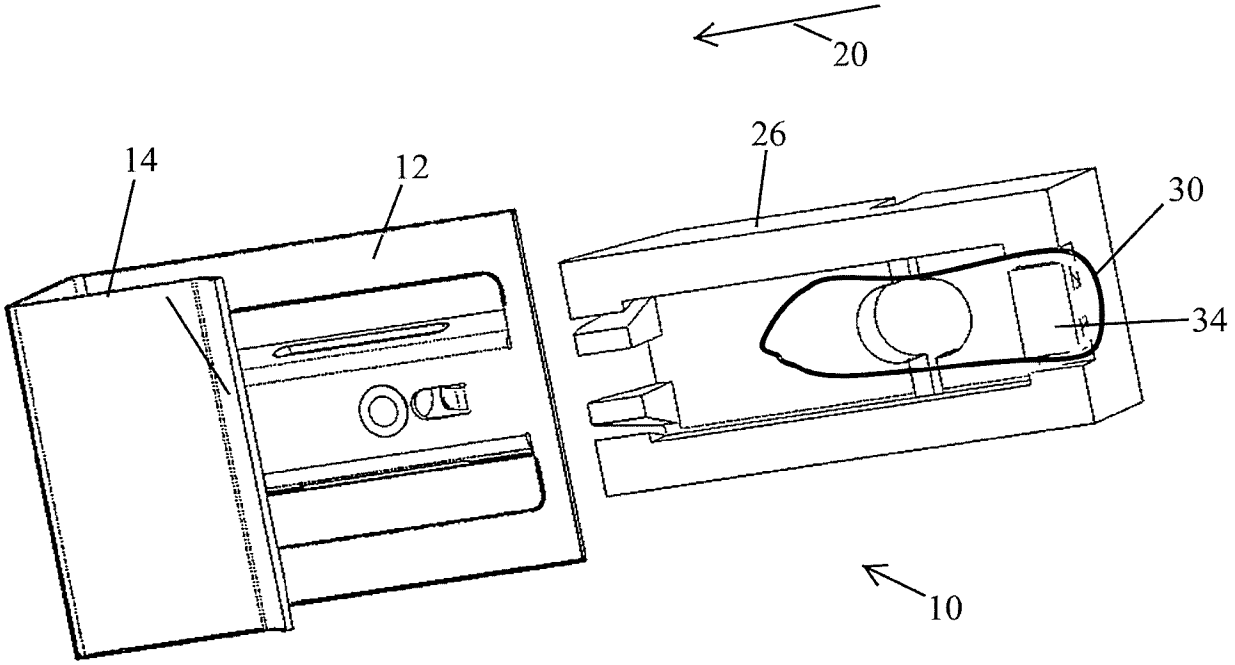
FIG. 3 is a reverse perspective, exploded view of the finger pinch protector device shown in FIG. 1.

As best seen in the perspective, exploded view in FIG. 2, a latch spring mechanism urges the elongated latch 26 along the guide rails of the clamp 12 toward the doorjamb. In the embodiment of FIG. 2, the latch spring mechanism includes an elastic band 30 extending between the clamp 12 and the elongated latch 26. In order to install the latch spring mechanism, the elastic band 30 is looped or hooked around a clip 32 extending from the planar body of the clamp 12. Thereafter, as shown in the reverse perspective, exploded view in FIG. 3, the elastic band 30 is looped or hooked over a post or protrusion 34 in the latch 26. Accordingly, once assembled, the latch spring mechanism urges the elongated latch 26 to move on the clamp 12 toward the doorjamb.

Figure 4:
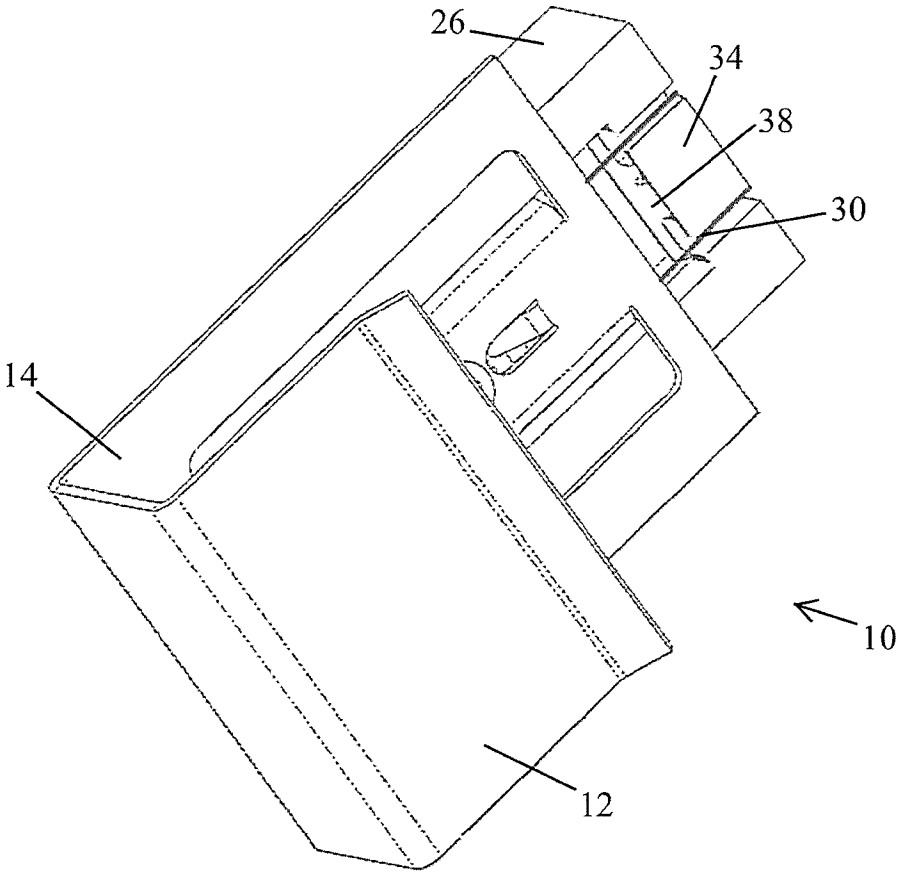
FIG. 4 is a perspective view of the clamp and the latch assembled together with a latch spring mechanism of the finger pinch protector device.

FIG. 4 illustrates a perspective view of the clamp 12 and the latch 26 assembled together with the latch spring mechanism. Spring tension from the elastic band 30 of the latch spring mechanism will urge and pull the latch 26 along the guide rails 16 of the clamp 12 until the clamp 12 engages a shoulder 38 of the latch 26. Accordingly, the shoulder 38 acts as a stop for movement of the latch 26.

Figure 5:
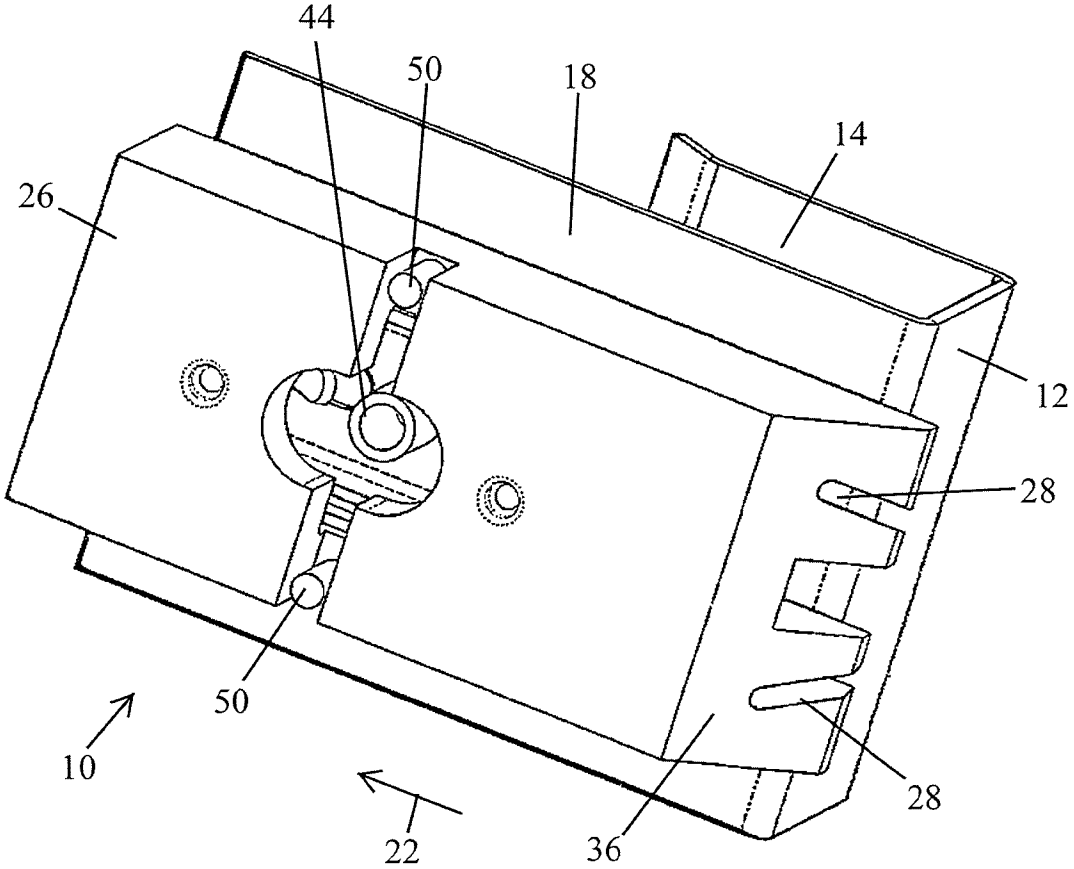
FIG. 5 is an alternate perspective view of the clamp and latch shown in FIG. 4.

As best seen in the perspective view in FIG. 5, the beveled edge 36 of the latch 26 extends beyond the clamp 12 when the spring mechanism has urged the latch 36 on the clamp 12. When installed over a door, the beveled end 36 of the latch 26 extends past the side edge of the door. When the beveled end 36 of the latch 26 of the device 10 comes in contact with a doorjamb, the force of the doorjamb will urge the latch 26 against and overcome the force of the latch spring mechanism. The doorjamb exerts a force shown by arrow 22 shown in FIG. 5.

Figure 6:
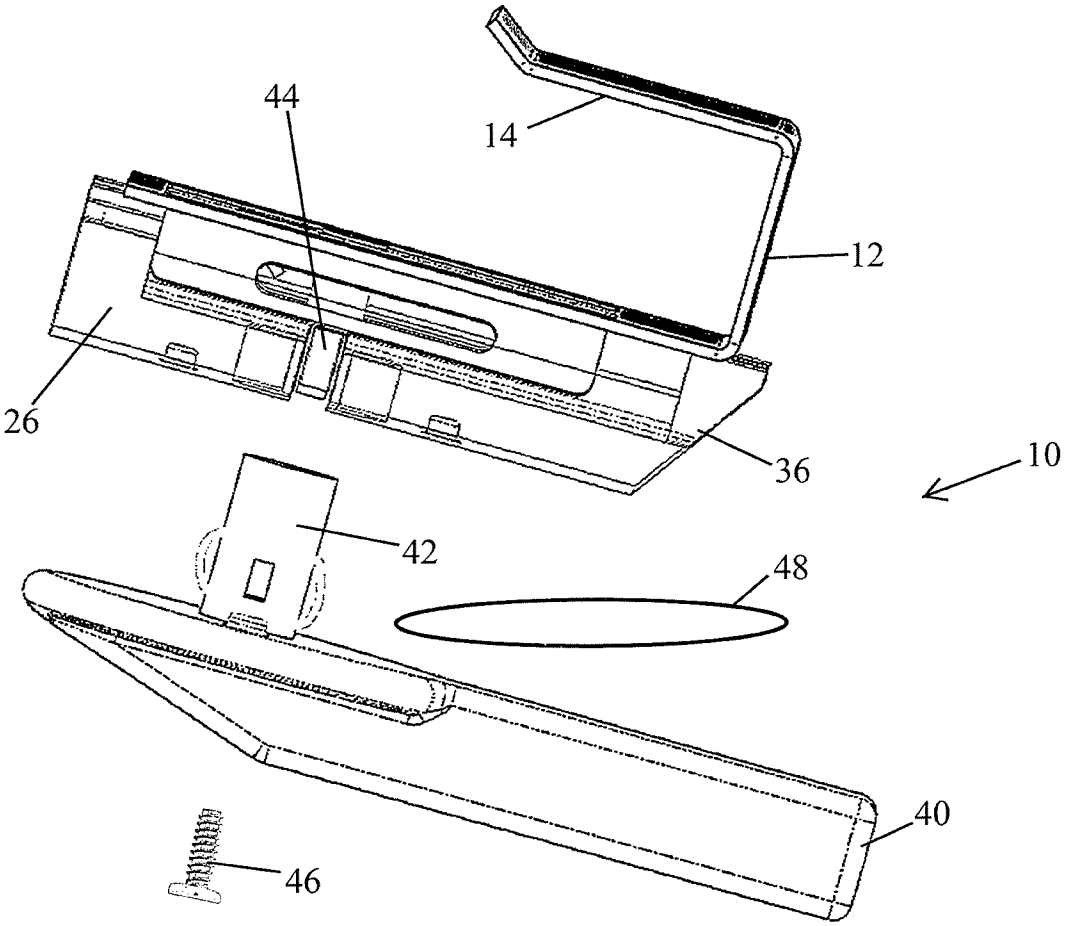
FIG. 6 is a side view of the clamp and elongated latch assembled together along with a rotor exploded therefrom.

FIG. 6 is a side view of the clamp 12 and elongated latch 26 assembled together. A rotor 40 of the device 10 is shown apart from and exploded from the clamp 12 and the latch 26. The rotor 40 has an extending post 42 with a tubular opening which is received over a cylinder 44 extending from the planar body 18 of the clamp 12. A fastener 46 passes into the tubular opening of the post and engages the cylinder 44. In one embodiment, the fastener 46 is a threaded screw which engages a threaded opening in the cylinder 44 of the clamp 12.

The extending post 42 and cylinder 44 act as an axis of rotation for the rotor 40. The rotor 40 rotates approximately 90 degrees between a vertical position and a safety horizontal position which is substantially parallel to both the latch 26 and the clamp 12.

Figure 7:
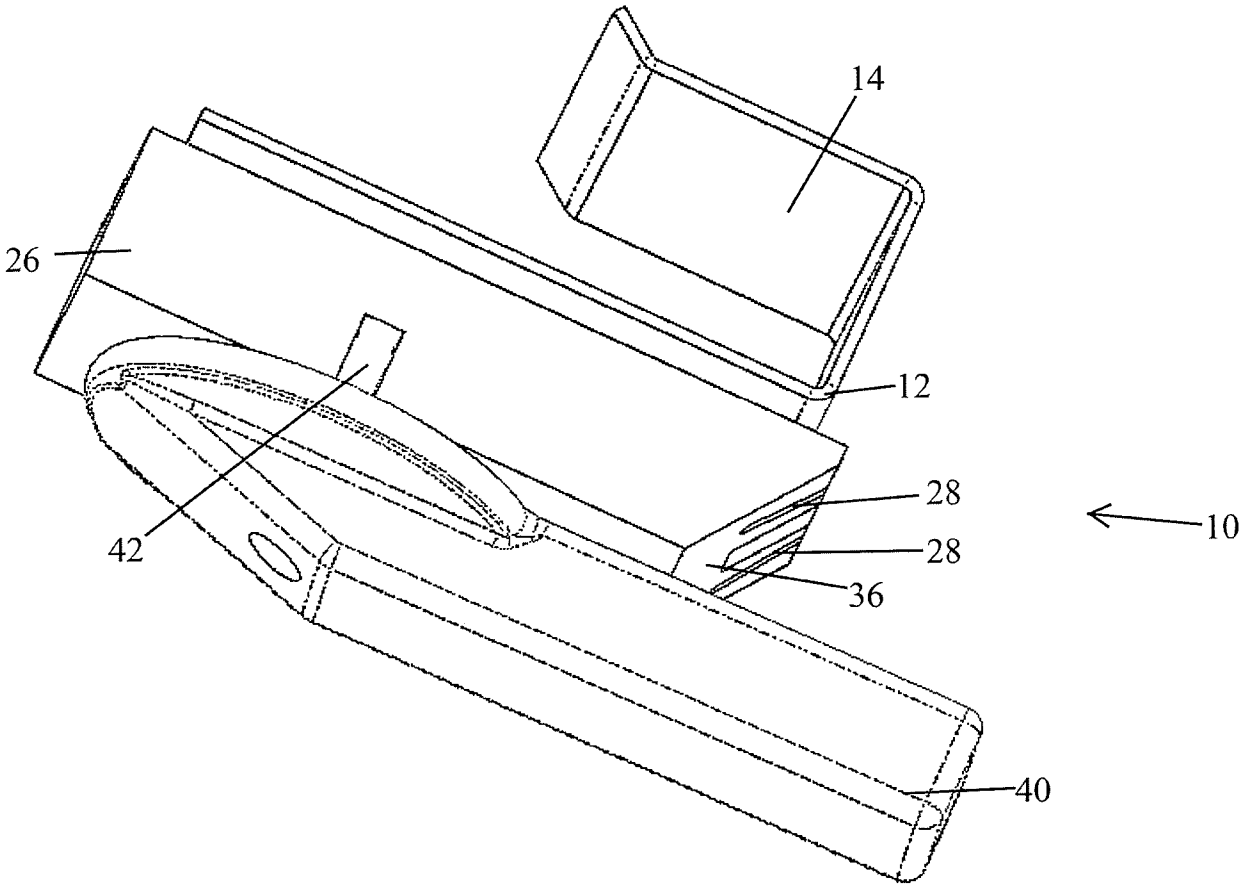
FIG. 7 is a perspective view of the device assembled together.

A rotor spring mechanism extends between the rotor 40 and the latch 26. In the embodiment shown, the rotor spring mechanism is an elastic band 48 which is installed by being 15 threaded through an opening in the post 42 and thereafter looped or hooked around opposed extending pins 50 extending from the latch. The extending pins 50 may best be seen in FIG. 5. FIG. 7 illustrates a perspective view of the device 10 fully assembled.

Figure 8:
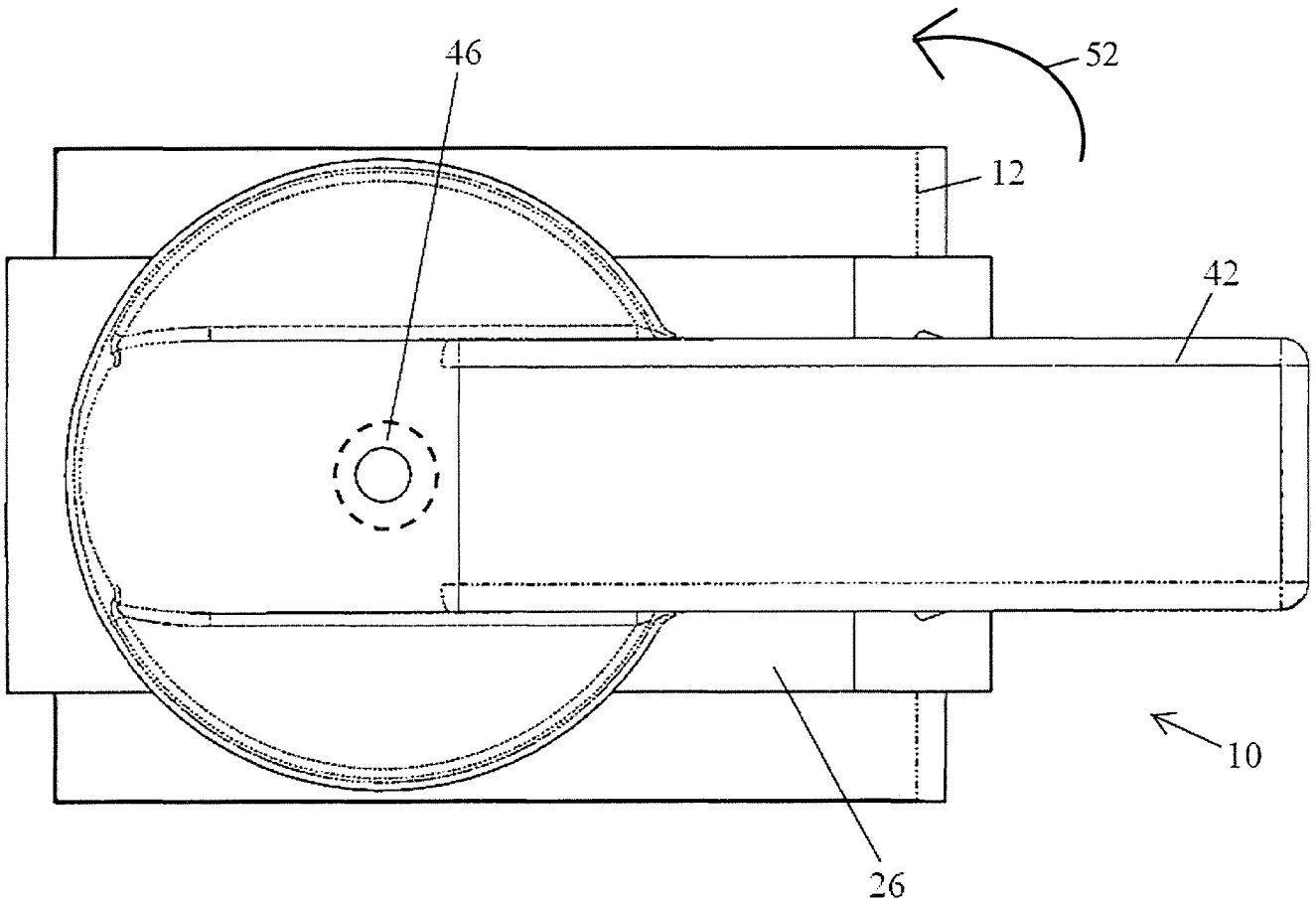
FIG. 8 is a top view of the device with the rotor in a horizontal safety position.
Figure 9:
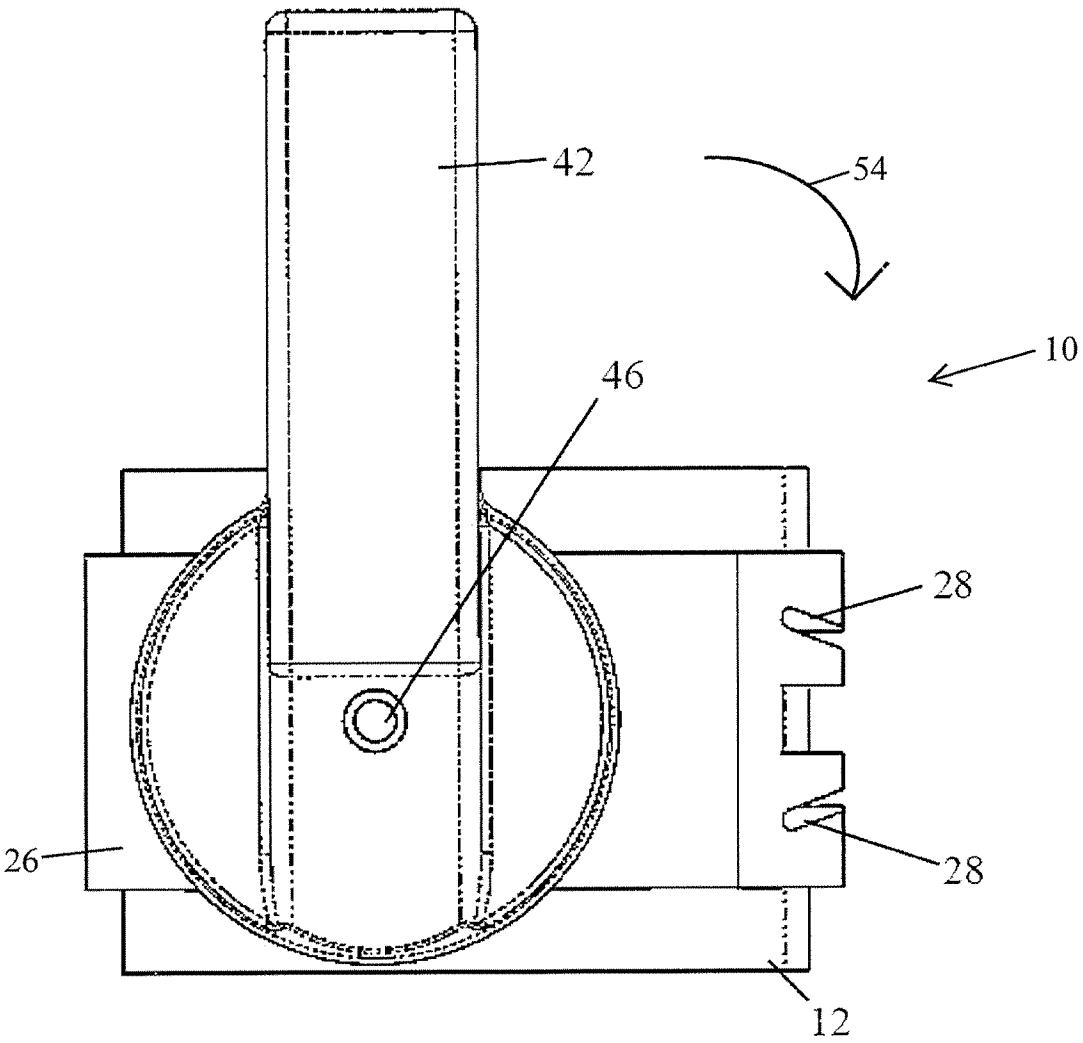
FIG. 9 is a top view of the device with the rotor in a vertical position.

The rotor 40 can rotate between a horizontal safety position shown in the top view in FIG. 8 and a vertical position shown in the top view in FIG. 9. The rotor spring mechanism urges the rotor 40 toward the horizontal safety position. When in the horizontal safety position, the rotor 40 extends beyond the edge of the clamp 12 and, thus, beyond the side edge of the door. In order to move the rotor 40 to the vertical position, the rotor 40 is rotated in the direction shown by arrow 52 in FIG. 8. The rotor 40 is shown in the vertical position in FIG. 9 and may be moved in the direction shown in FIG. 9.

Figure 10:
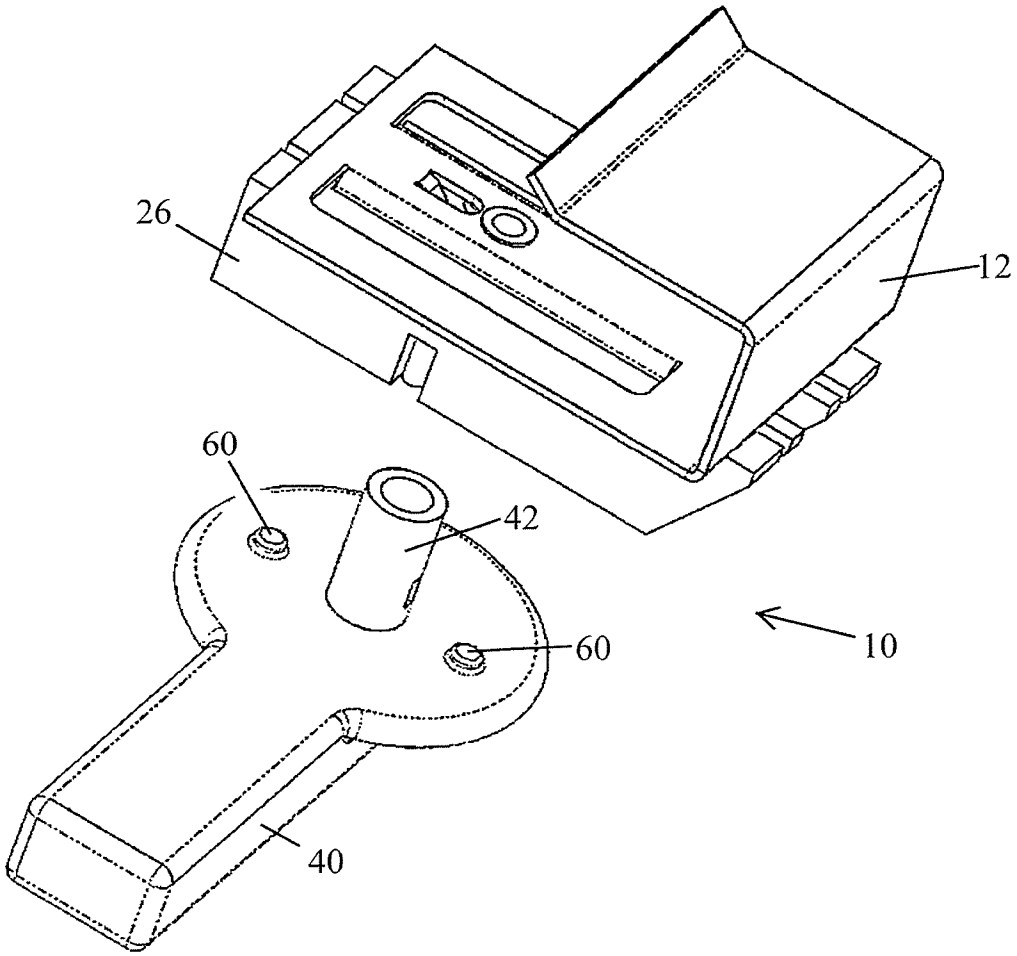
FIGS. 10 and 11 are alternate perspective views of the rotor exploded from the clamp and latch of the device.
Figure 11:
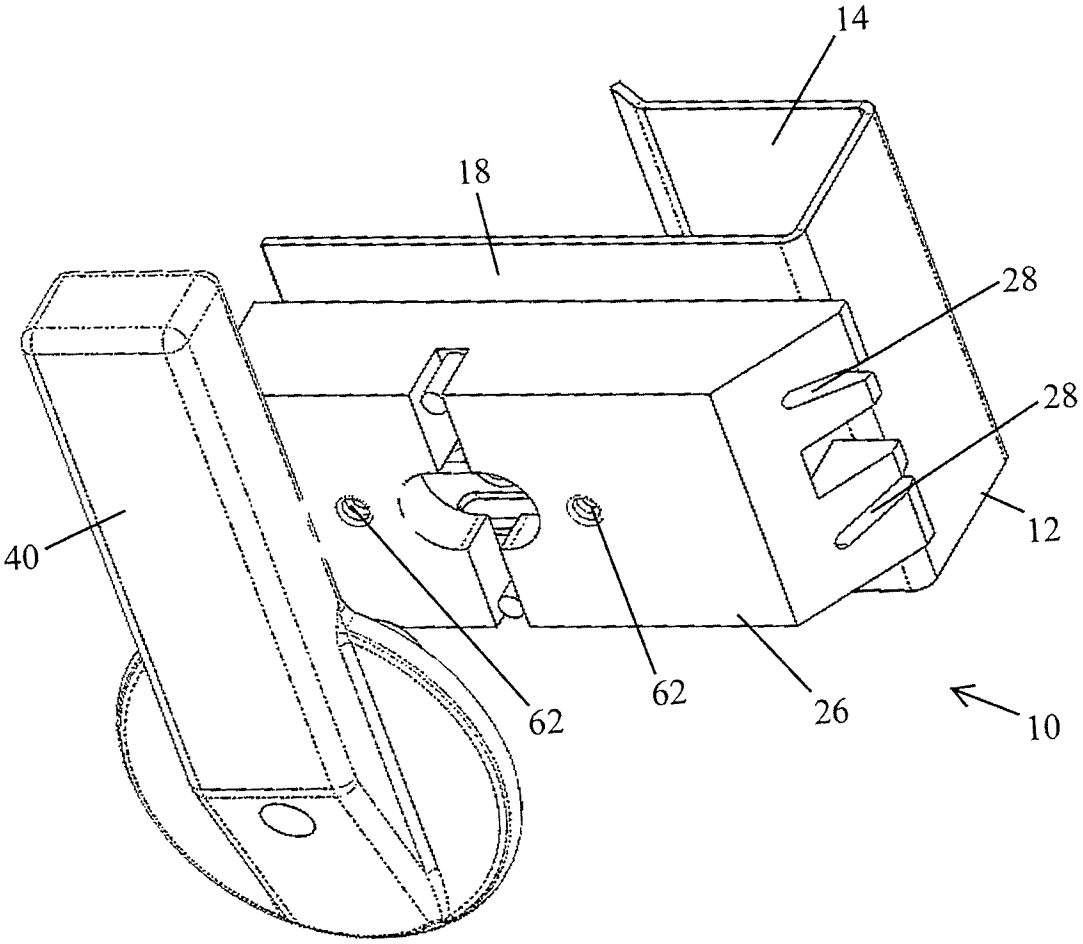
Figure 12:
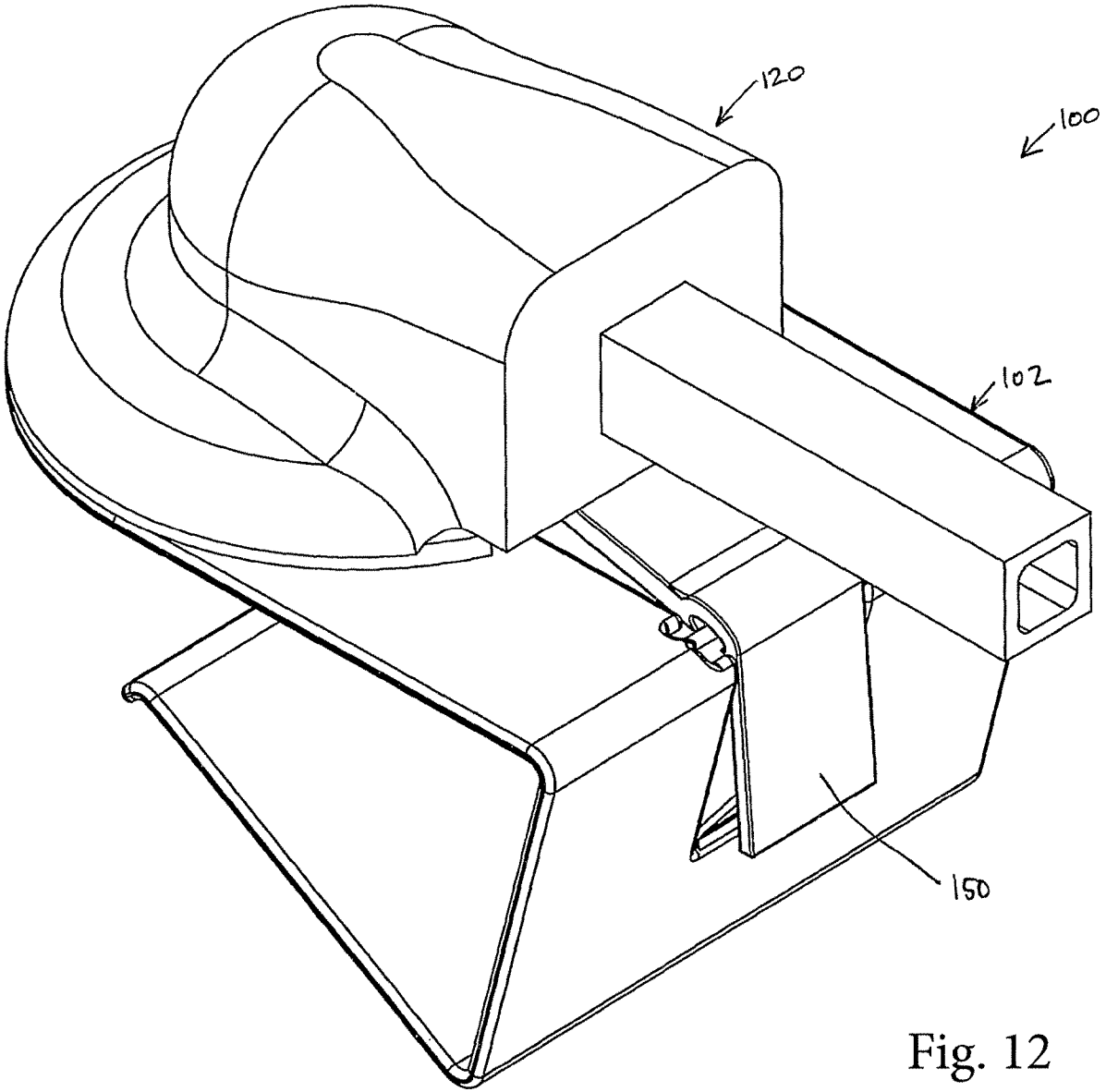
FIG. 12 is a perspective view of a door stop according to embodiments of the invention.

FIGS. 10 and 11 show alternate perspective views of the rotor 40 exploded from the clamp 12 and latch 26.

An underside of the rotor 40 contains a pair of locating pins 60. The locating pins 60 mate with corresponding recesses 62 in the latch 26. The pins 60 in the recesses 62, thus, retain the rotor 40 in the vertical position.

When the latch 26 engages the doorjamb, the latch 26 is urged or moved with respect to the clamp 12. At the same time, the rotor locating pins 60 of the rotor are forced from the locating recesses 62 on the latch 26. Once the pins 60 are removed from the recesses, the force of the rotor spring mechanism thereby forces the rotor 40 to rotate from the vertical position and move back to the horizontal safety position. As the rotor 40 projects beyond the edge of the door, the rotor 40 thereby prevents a door from closing.

Referring now to FIGS. 12-18, a doorstop 100 broadly includes a clamping portion 102 and a rotating member 120. As will be described in greater detail below, the rotating member 120 is maintained in an open position via a biasing member 150 that is operably secured between the clamping portion 102 and the rotating member 120. As with the clamp 12, the clamp 102 may be configured to fit around a side edge of a door. The width of the clamp 102 may be slightly less than a width of the side edge of the door such that the clamp 102 is maintained in place on the door by spring force.

Figure 14:
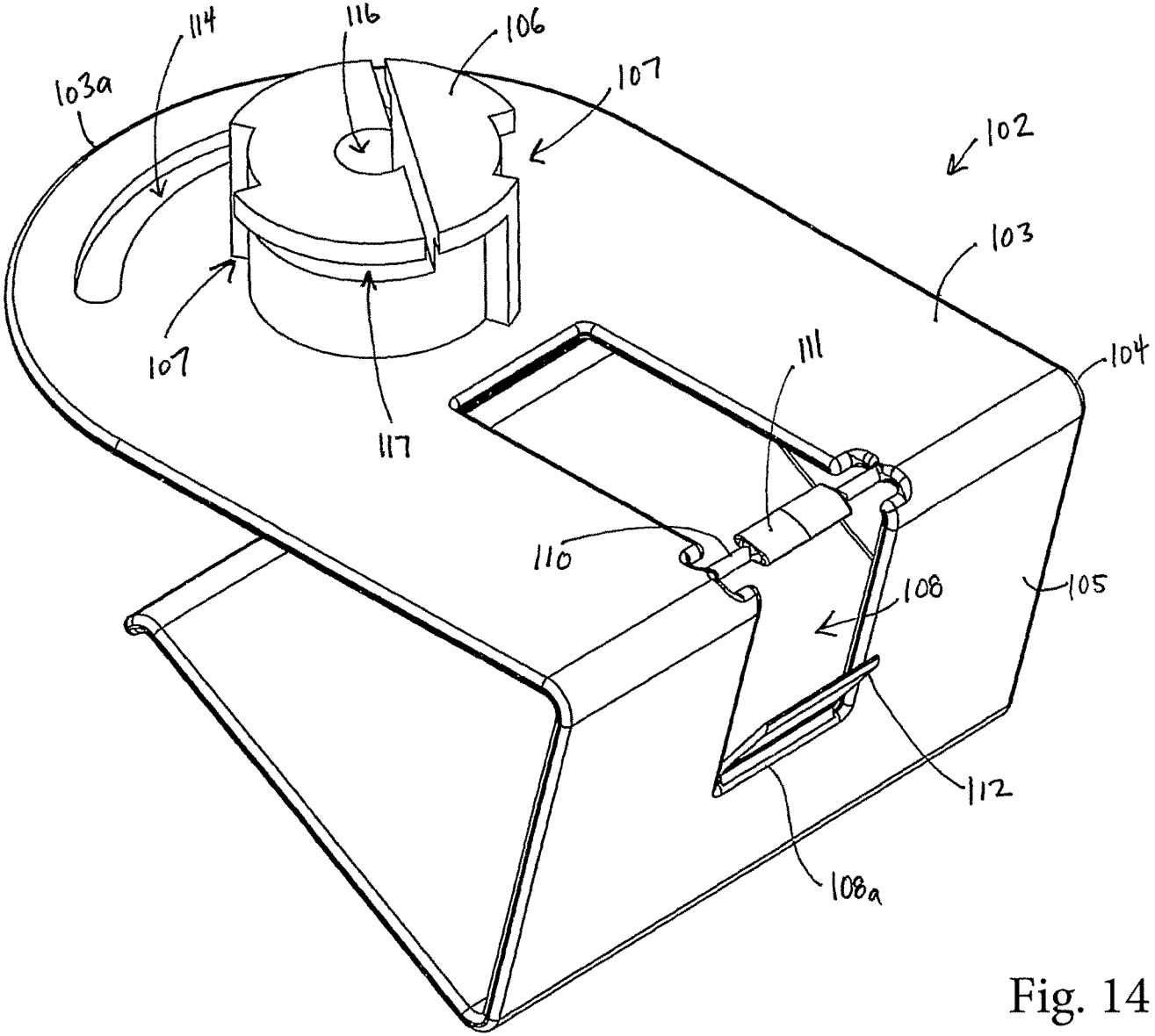
FIG. 14 is a perspective view of a clamping portion of the door stop of FIG. 12.
Figure 17:
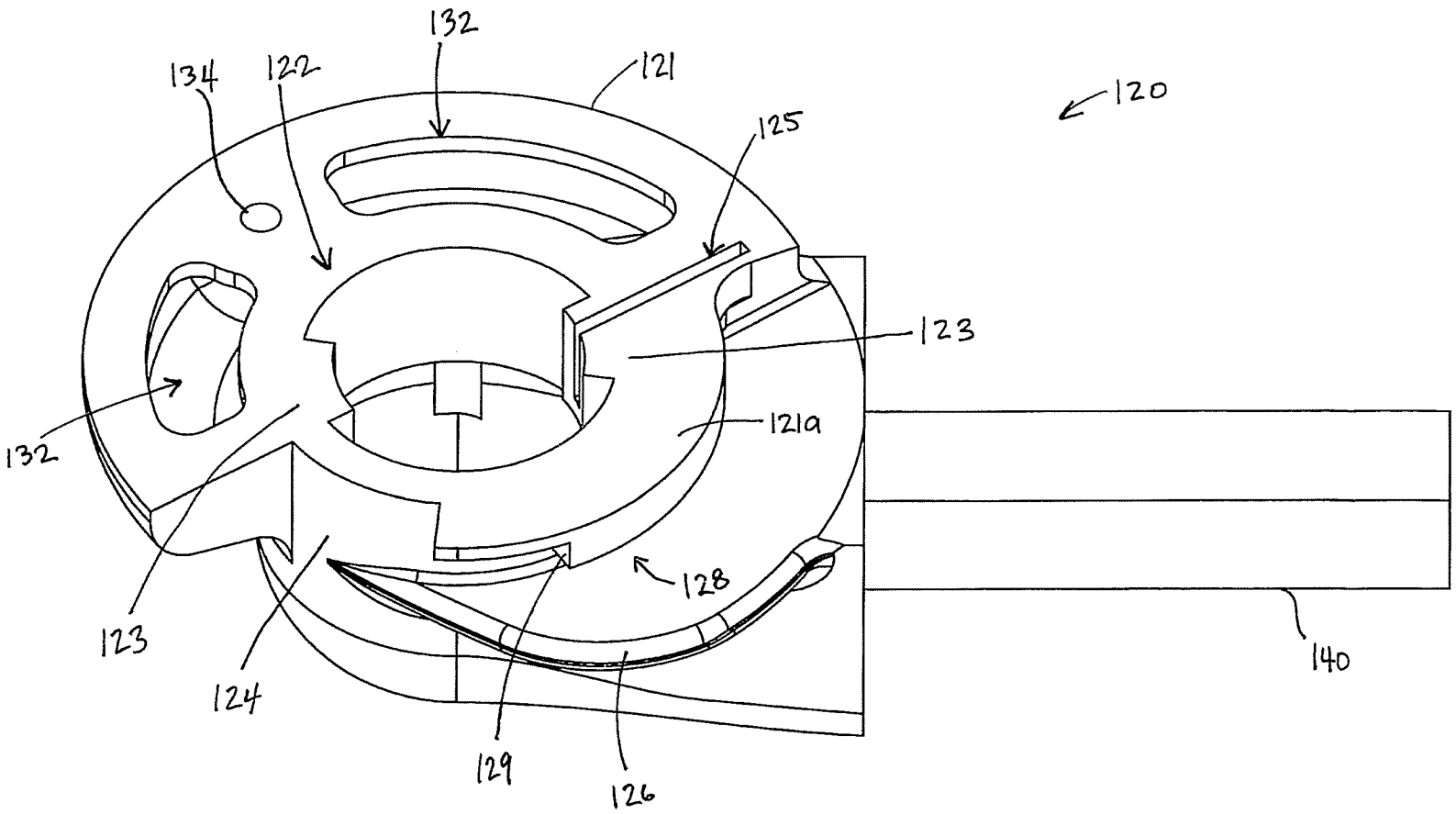
FIG. 17 is a bottom perspective view the rotating member of the door stop of FIG. 12.

Best illustrated in FIG. 14, the clamp 102 has a front face 103 configured to interface with the rotating member 120. A locking projection 106 extends from the front face 103. The locking projection 106 may have a specific configuration to mate with a corresponding rotating member 120. Here, openings 107 in the projection 106 correspond with protrusions 123 in a receiving portion 122 of the rotating member 120 as shown in FIG. 17. Accordingly, the projection 106 is received into the receiving portion 122 by aligning the openings 107 in the projection 106 with the protrusions 123 in the receiving portion 122 to couple the rotating member 120 to the clamp 102.

Figure 15:
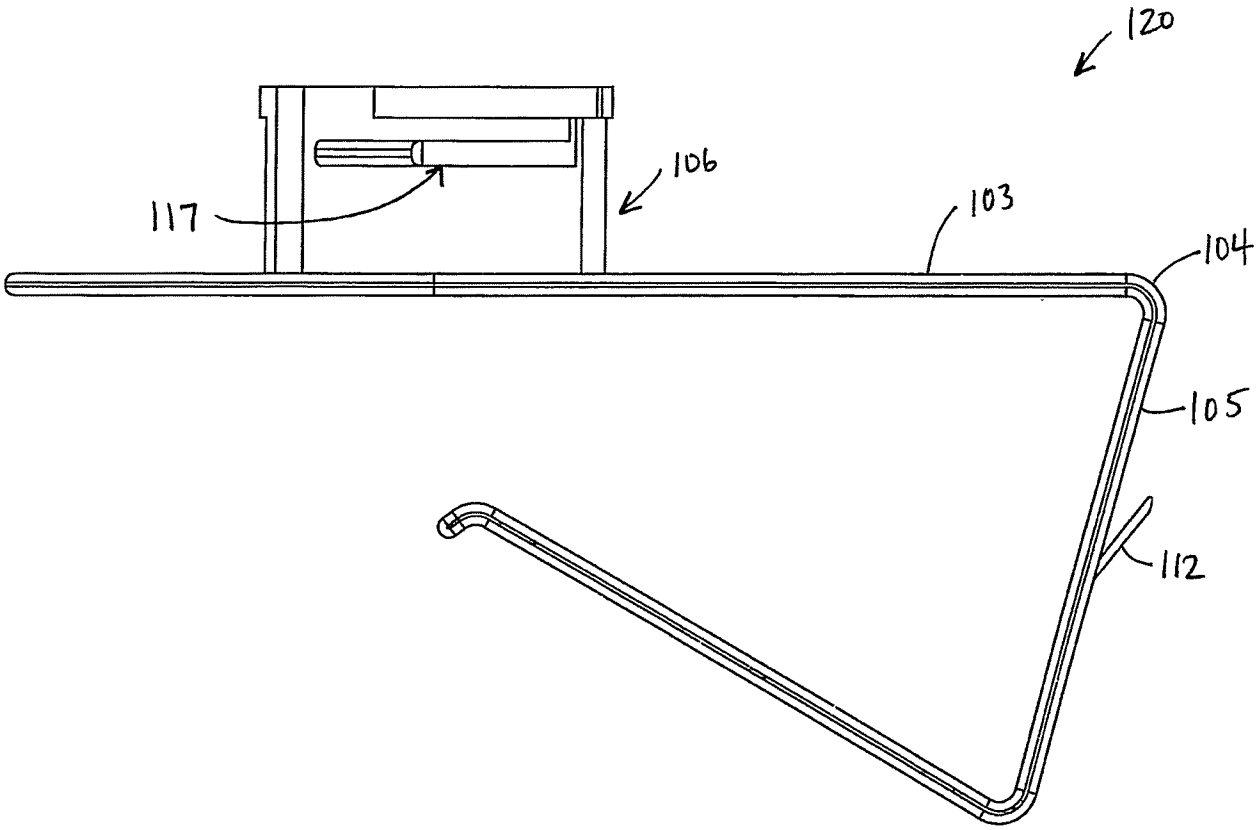
FIG. 15 is a side view of the clamping portion of the door stop of FIG. 12.

Referring to FIGS. 14 and 15, a spring 118 (e.g., a torsion spring) is situated in a cavity 116 defined in the projection 106. One arm of the spring 118 extends outwardly from the cavity 116 to engage with the rotating member 120 as discussed below, while the other arm is maintained within the projection 106. The spring arm is permitted to travel within a groove 117 formed in the projection 106 such that the rotating member 120 can rotate between an open and closed position.

An opening 108 is defined in the front face 103 and the corresponding side face 105 of the clamp 102 for receiving the biasing member 150. A crossbar 110 extends across the opening 108 at a location of the front face 103 just ahead of the transition 104 between the front face 103 and the side face 105. In some embodiments, the crossbar includes a wider portion 111 for engaging with the biasing member 150 as described below. A wing 112 extends outwardly (i.e., away from the center of the clamp 102) at an angle from an end 108*a* of the opening 108. The wing 112 may be integrally formed as part of the clamp 102 (e.g., molded, co-extruded, etc.) or the wing 112 may be formed separately from the clamp 102 and adhered to the edge of the opening 108*a*.

A track 114 may be defined near a leading edge 103*a* of the front face 103. The track 114 may have a curved configuration, and may generally follow the curve of the leading edge 103*a*, although this is not required. In some embodiments, the track 114 may be configured as approximately a 180-degree curve. In other embodiments, the curve of the track 114 may be less than 180-degrees, and may be, for example about 170-, 160-, 150-, 140-, 130-, 120-, 110-, 100-, or even 90-degrees. In still further embodiments, the curve of the track 114 may be about 80-, 70-, 60-, 50-, or 40-degrees.

Figure 16:
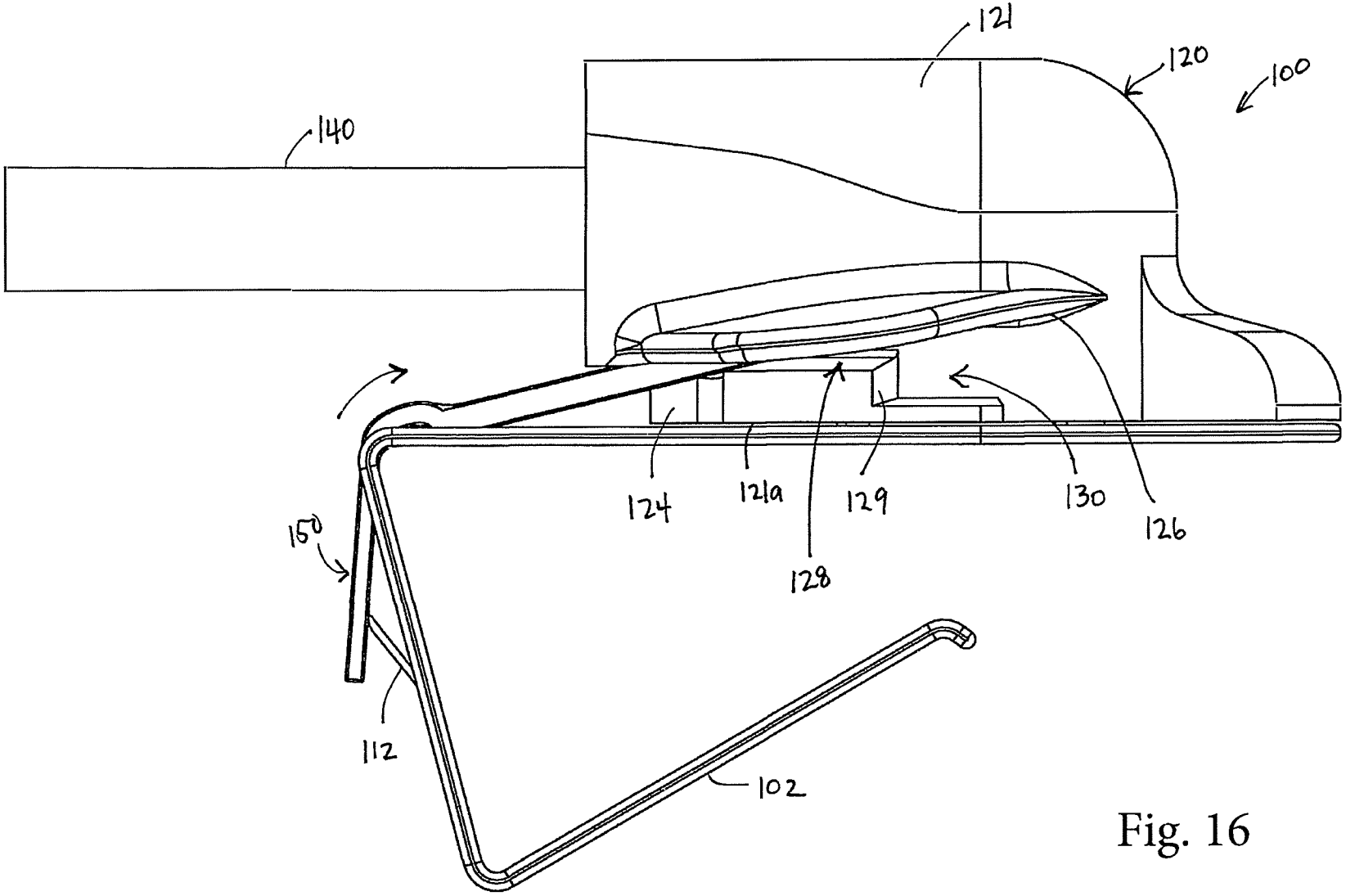
FIG. 16 is a side view of the door stop of FIG. 12.

Moving on, and with reference to FIGS. 16 and 17, the rotating portion 120 broadly includes a joining assembly 121 and an arm 140 extending from the joining assembly 121. As described briefly above, the receiving portion 122 of the joining assembling 121 is configured to mate with the projection 106 on the clamp 102. The receiving portion 122 further includes a cutout 125 for receiving the arm of the spring 118. Thus, when the rotating portion 120 is connected to the clamp 102, the spring arm is positioned within the cutout 125 such that the rotating portion 120 rotates between an open and closed position wherein the spring arm travels along the groove 117 in the projection 106. In use, the spring 118 naturally biases the arm 140 into the closed position (i.e., the door blocking position). When the arm 140 is moved into the open position (i.e., not blocking the door from being closed) the spring 118 is twisted, increasing the torsion in the spring 118 such that, when the arm 140 is released from the open position, the torque causes the arm 140 to move into the closed position.

Figure 13:
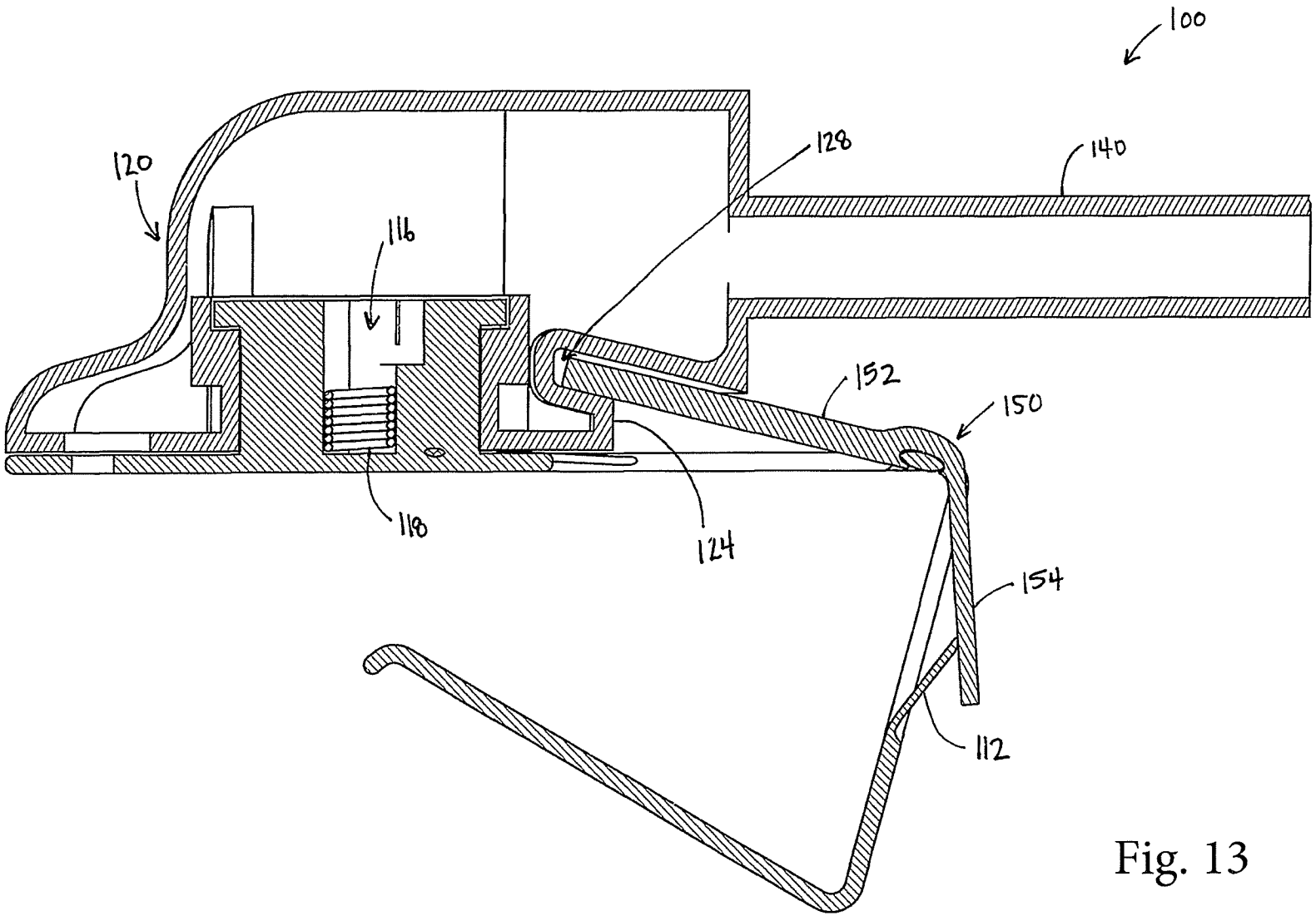
FIG. 13 is a side section view of the door stop of FIG. 12.

As shown in FIG. 16, a channel 128 is defined in an outside edge 124 of the receiving portion 121 between a bottom face 121*a* of the joining assembly 121 and a lip 126 extending therefrom. Optionally, the channel 128 may be angled relative to horizontal, as illustrated in FIG. 13. A wall 129 is defined at the end of the channel 128 to form a gap 130 for receiving an end of the biasing member 150, described below.

Optionally, openings 132 may be formed in the bottom face 121*a* of the joining assembly 121. The openings 132 may reduce the amount of material required for the rotating member 120, thus reducing material cost. Finally, a pin 134 may protrude from the bottom face 121*a*. The pin 134 may be configured to fit within the track 114 on the clamp 102 when the rotating member 120 is secured to the clamp 102. When engaged within the track 114, the pin 134 prevents the rotating member 120 from rotating beyond the degree of the curve of rotation of the track 114.

Figure 18:
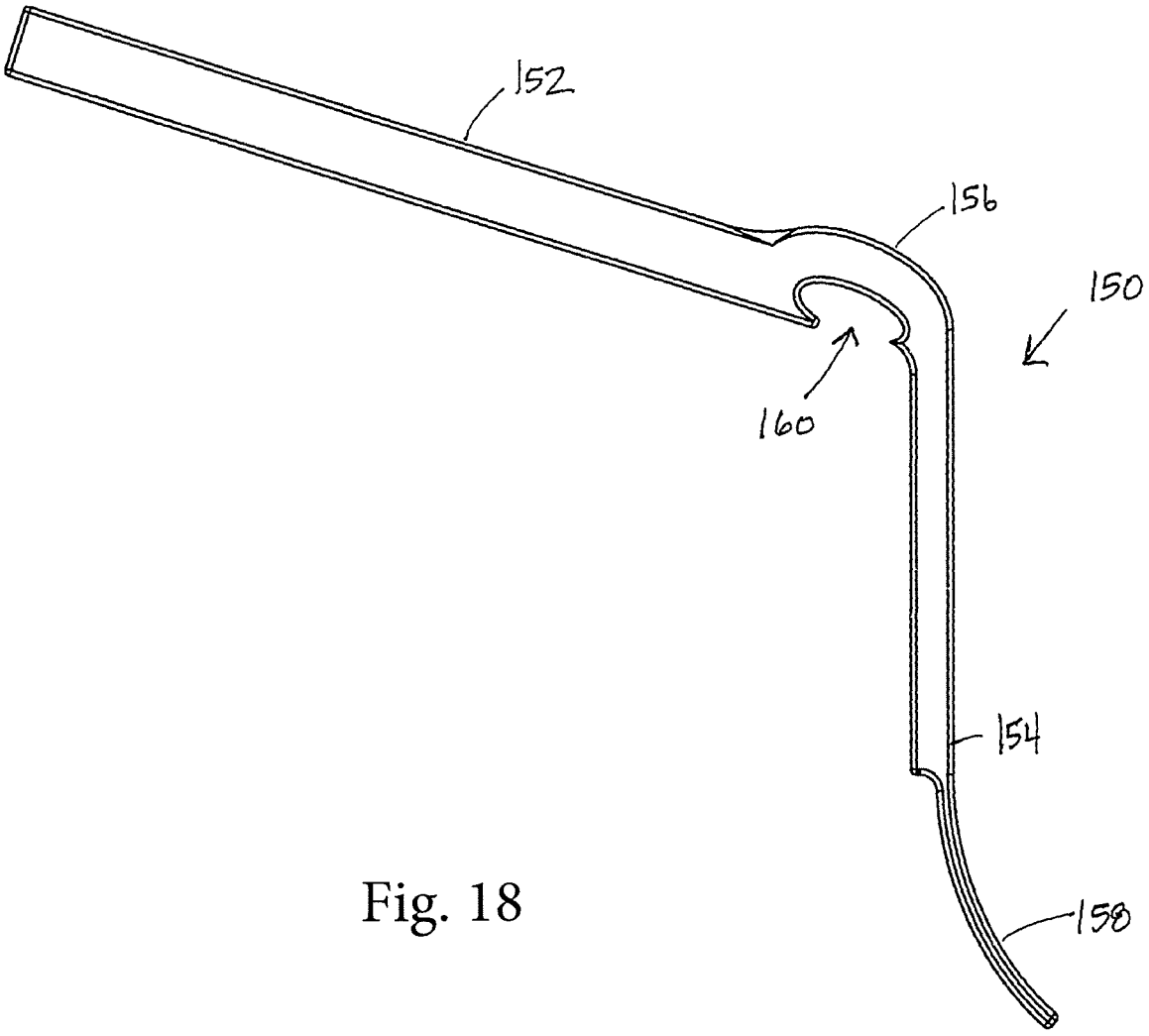
FIG. 18 is a side view of a biasing member of the door stop of FIG. 12.

Moving on to FIG. 18, the biasing member 150 is generally configured into an "L" shape, having a first leg 152, a second leg 154, and a transition portion 156. The second leg 154 concludes in a curved portion 158. In embodiments, a width of the curved portion 158 is smaller than a width of the remainder of the second leg 154. The width of the second leg 154 may be greater than, less than, or equal to a width of the first leg 152. In some embodiments, the width of the second leg 154 is less than the width of the first leg 152. An inside surface of the transition portion 156 has a channel 160 formed for receiving the crossbar 110, and specifically, portion 111 of the crossbar 110.

FIGS. 13 and 16 best illustrate the door stop 100 in its operable configuration. In the operation configuration, the biasing member 150 is secured to the clamp 102 by inserting the portion 111 of the crossbar 110 into the channel 160 in the transition portion 156. The rotating member 120 mates with the clamp 102 as described above, and when so mated, the first leg 152 of the biasing member 150 is received into the channel 128. The door stop 100 is then ready to be placed in use on a door.

When the clamp 102 is placed on a side edge of a door, a force is exerted on the biasing member 150 causing the biasing member 150 to rotate in the direction of the arrow shown in FIG. 16. As described above, the natural tendency of the spring 118 is to maintain the arm 140 in the closed position. Thus, when the clamp 102 is placed on the side edge of the door, in the closed position, the arm 140 should prevent the door from closing. Once the clamp 102 is in place on the side edge of the door, the arm 140 is rotated into the open position (i.e., the door, but for the door stop 100, would be permitted to close). Due to the force on the biasing member 150, when the arm 140 is rotated into the open position, the first arm 152 of the biasing member 150 snaps into the gap 130 and abuts the wall 129, thus preventing the arm 140 from rotating back into the closed position. In the open position on the side of the door, the door stop 100 is ready to discharge.

When the door is shut, the side of the door with the door stop 100 meets the door jamb. However, before the door can shut, the door jamb pushes against the second leg 154 of the biasing member 150, forcing the first leg 152 out of the gap 130 and into the channel 128. The spring 118 then forces the arm 140 to rotate into the closed position, wherein the arm 140 is forced between the door and the door jamb, thus preventing the door from closing. The door stop 100 may be reloaded by rotating the arm 140 back into the open position as described above.

The arm 140 may take any shape and be formed of any appropriate material. In embodiments, the arm 140 is generally rectangular, and the edges of the arm 140 may optionally be rounded. In further embodiments, the arm 140 may be ovular, for example. Further configurations of the arm 140 may be appropriate and are considered to be within the scope of this disclosure. The arm material is preferably a material that is strong enough to prevent the door from closing but will not damage the door and/or the door jamb. In some embodiments, the arm 140 is constructed of a pliable or elastic material including but not limited to various types of polymers, foams, rubbers, plastics, et cetera.

As described herein, the invention provides a door stop for a door that may be installed or removed without any tools, that will not mar or otherwise damage a door, and that will be activated by engagement of the door with the jamb. The invention has been described in relation to the drawings attached hereto; however, it should be understood that other and further modifications, apart from those shown or suggested herein, may be made within the scope of this invention.

What is claimed is:

1. A door stop for a door comprising:

a clamp securable over a first side edge of a door, the clamp having a guide;

an arm, comprising:

a receiving portion for receiving the guide to permit movement of the arm on the clamp between an open position and a closed position;

a channel formed in an outer surface of the arm, the channel further defining a wall and a gap adjacent the wall;

a spring mechanism operably coupled to the clamp and the arm, the spring mechanism urging the arm on the guide of the clamp toward the closed position; and a biasing member secured to the clamp, a first portion of the biasing member engaging with the channel in the arm to rotate the arm between the closed and open positions;

wherein:

in the open position, the first portion of the biasing member is disposed in the gap in the arm such that it abuts the wall thus preventing rotation of the arm from the open position to the closed position; and in the closed position, the arm prevents the door from engaging with a respective door jamb.

2. The door stop of claim 1, wherein the clamp is secured over the first side edge of said door by spring force.

3. The door stop of claim 1, wherein the arm rotates approximately ninety degrees between the open and closed positions.

4. The door stop of claim 1, wherein the spring mechanism comprises a torsion spring.

5. The door stop of claim 1, wherein, when closing the door, the first side edge of the door reaches the doorjamb, the door jamb exerts a force on a second portion of the biasing member, the force causing the first portion of the biasing member to leave the gap and enter the channel in the arm, whereby the arm rotates from the open position to the closed position.

6. The door stop of claim 1, wherein the guide comprises a projection having at least one groove formed at an edge thereof.

7. The door stop of claim 6, wherein the receiving portion comprises at least one protrusion, and wherein the protrusion in the receiving portion corresponds to the groove formed in the projection for mating the arm with the clamp.

8. The door stop of claim 1, wherein:

the clamp further comprises a track;

the arm further comprises a pin; and the pin is received into the track when the arm is attached to the clamp to limit rotation of the arm.

9. The door stop of claim 1, wherein the arm comprises an extension portion, and wherein the extension portion comprises an elastic material.

10. A door stop for a door comprising:

a clamp securable over a first side edge of a door, the clamp having a guide comprising a projection having at least one groove formed at an edge thereof and an opening;

an arm having a receiving portion for receiving the guide to permit movement of the arm on the clamp between an open position and a closed position;

a spring mechanism operably coupled to the clamp and the arm, the spring mechanism urging the arm on the guide of the clamp toward the closed position;

wherein:

a first portion of the spring mechanism is situated within the opening in the projection;

a second portion of the spring mechanism extends outside of the opening to engage with the arm; and in the closed position, the arm prevents the door from engaging with a respective door jamb.

11. The door stop of claim 10, wherein the arm comprises a cutout, and wherein the second portion of the spring mechanism is situated within the cutout.

12. A method of preventing a door from closing, comprising:

securing a door stop to a first side edge of a door hingedly attached to a door jamb, the door stop comprising:

a clamp having a guide and a biasing member;

a rotating member comprising:

a joining assembly, comprising:

a receiving portion configured to receive and rotate about the guide between an open and closed position; and a channel formed in an outer surface of the joining assembly and further defining a wall and a gap adjacent the wall; and an arm extending from the joining assembly;

a spring mechanism operably secured to the clamp and the rotating member, the spring mechanism urging the arm toward the closed position;

wherein:

a first portion of the biasing member engages with the channel in the arm to rotate the arm between the closed and open positions;

in the open position, the first portion is disposed in the gap such that it abuts the wall thus preventing rotation of the arm from the open position to the closed position; and moving the arm into the open position;

wherein, when the first side edge of the door reaches the doorjamb, the door jamb exerts a force on a second portion of the biasing member, the force causing the first portion of the biasing member to enter the channel in the joining assembly, whereby the arm rotates from the open position to the closed position thus preventing the door from closing.

13. The method of claim 12, wherein the guide comprises a projection having at least one groove formed at an edge thereof.

14. The method of claim 13, wherein the receiving portion comprises at least one protrusion, the at least one protrusion corresponding to the groove in the projection for mating the rotating member to the clamp.

15. The method of claim 14, wherein:

the projection further comprises an opening defined therein;

the joining assembly further comprises at a cutout;

a first portion of the spring mechanism is situated within the opening, in the projection; and a second portion of the spring mechanism is situated within the cutout.

16. A door stop, comprising:

a clamp securable over a side edge of a door supported within a door jamb, the clamp comprising:

first, second, and third faces generally having a "U" configuration, the first and second faces being adjacent and having an opening therein and a crossbar extending across the opening;

a projection extending from the first face, the projection comprising:

a vertical opening formed along an outside edge thereof;

a cavity; and a horizontal groove defined along a portion of a circumference of the projection;

a track defined in the first face along an outside edge thereof; and a spring comprising a first portion and a second portion, the first portion being situated within the cavity, and the second portion extending into the horizontal groove and away from the projection;

a rotating member secured to the clamp, the rotating member comprising:

a joining assembly having a bottom face and comprising:

a receiving portion comprising a protrusion and a cutout;

a channel formed along an outside edge of the joining assembly between the bottom face and a lip extending therefrom, the channel further defining a wall and a gap adjacent the wall; and a pin extending from the bottom face; and an arm extending from the joining assembly;

wherein:

the protrusion of the receiving portion is received into the vertical opening of the projection of the clamp to mate the rotating member with the clamp;

when mated:

the second portion of the spring is received into the cutout in the receiving portion and biases the rotating member between an open and closed position; and the pin extends into the track in the clamp; and a biasing member comprising a first leg and a second leg generally having an "L" configuration, the biasing member engaging with the crossbar of the clamp;

wherein:

in the closed position, the first leg of the biasing member engages with the channel in the joining assembly;

in the open position, the first leg of the biasing member is disposed in the gap in the joining assembly such that the first leg abuts the wall, thus preventing the arm from moving from the open position to the closed position; and when closing the door, and the first edge of the door reaches a door jamb, the door jamb exerts a force on the second leg of the biasing member, the force causing the first leg of the biasing member to leave the gap and enter the channel in the joining assembly, whereby the arm rotates from the open position into the closed position.

17. The door stop of claim 16, wherein the arm comprises an elastic material.

18. The door stop of claim 16, wherein the second leg of the biasing member further comprises a curved portion.

* * * * *